US007812535B2

(12) United States Patent
Song

(10) Patent No.: US 7,812,535 B2
(45) Date of Patent: Oct. 12, 2010

(54) PLASMA DISPLAY PANEL

(75) Inventor: Jung-Suk Song, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 21 days.

(21) Appl. No.: 12/382,463

(22) Filed: Mar. 17, 2009

(65) Prior Publication Data

US 2009/0236987 A1 Sep. 24, 2009

(30) Foreign Application Priority Data

Mar. 18, 2008 (KR) ..... 10-2008-0024903

(51) Int. Cl.
*H01J 17/49* (2006.01)

(52) U.S. Cl. ..... 313/582; 313/586

(58) Field of Classification Search ..... 313/582, 313/584, 586

See application file for complete search history.

(56) References Cited

U.S. PATENT DOCUMENTS 7,015,645 B2 * 3/2006 Kim et al. ..... 313/586
2009/0021168 A1 * 1/2009 Song ..... 313/582

* cited by examiner

*Primary Examiner*—Vip Patel
(74) *Attorney, Agent, or Firm*—Lee & Morse, P.C.

(57) ABSTRACT

A PDP includes first and second substrates facing each other, a plurality of inner barrier ribs in a display region between the first and second substrates to define display discharge cells, a plurality of dummy barrier ribs in a non-display region between the first and second substrates, the non-display region being peripheral to the display region, a plurality of electrodes between the first and second substrates to generate a discharge in the display discharge cells, a first dielectric layer on the first substrate, the first dielectric layer overlapping the display region and only a portion of the non-display region, at least one phosphor layer in each of the display discharge cells, and a frit in the non-display region connecting the first and second substrates, the dummy barrier ribs being arranged between the frit and the inner barrier ribs.

13 Claims, 1 Drawing Sheet

PLASMA DISPLAY PANEL

BACKGROUND OF THE INVENTION

1. Field of the Invention

Embodiments of the present invention relate to a plasma display panel (PDP). More particularly, embodiments of the present invention relate to a PDP with a dielectric layer structure capable of preventing a misdischarge at edges of the PDP.

2. Description of the Related Art

A PDP may refer to a flat panel display device that displays images via a discharge phenomenon. More particularly, the PDP may include a plurality of discharge cells filled with a discharge gas, so application of voltage to the discharge cells may generate ultraviolet (UV) light and trigger emission of visible light. In particular, the conventional PDP may be driven by generating a reset discharge, an address discharge, and a sustain discharge in each discharge cell, and the PDP may continuously form a predetermined image by controlling the sustain discharge in each discharge cell.

A conventional PDP may include first and second substrates, so the plurality of discharge cells and a plurality of electrodes may be arranged between the first and second substrates. The conventional PDP may further include a dielectric layer on the first substrate and barrier ribs between the first and second substrates to define the discharge cells.

The first and second substrates may be attached to each other via a frit layer in a peripheral region of the PDP. Since a height of the barrier ribs, however, may be different from a height of the frit layer, when the first and second substrates are pressed together, the first substrate and the dielectric layer thereon may not be capable of adjusting for the height difference between the barrier ribs and the frit layer. Therefore, a portion of the first substrate and a portion of the dielectric layer may be forced to protrude away from the barrier ribs in the peripheral region of the PDP, e.g., bending range of about −0.10 to about 0.00, while other portions of the first substrate and the dielectric layer may be substantially unbent. Such a protrusion may cause non-uniform gaps between the first and second substrates along edges thereof, e.g., at an edge region among regions formed at both sides along a longitudinal direction of the PDP, thereby causing misdischarge in corresponding regions of the PDP and areas adjacent thereto.

For example, the degrees of bending of the first and second substrates may be measured in the peripheral region of the PDP, e.g., a region extending away from the display region by about 80 nm at both sides in a horizontal direction of the PDP. If a difference in the degrees of bending of the first substrate is about 40 μm and a difference in the degrees of bending of the second substrate is about 25 μm, the gap between the first and second substrates may be about 15 μm. When a sustain voltage is applied to sustain electrodes to create a sustain discharge, such a gap may trigger a misdischarge in some peripheral regions of the PDP, so image quality of the PDP may deteriorate.

SUMMARY OF THE INVENTION

Embodiments of the present invention are therefore directed to a PDP, which substantially overcomes one or more of the disadvantages of the related art.

It is therefore a feature of an embodiment of the present invention to provide a PDP having a dielectric layer structure capable of preventing a misdischarge at an edge region of the PDP.

At least one of the above and other features and advantages of the present invention may be realized by providing a PDP, including a first substrate and a second substrate facing each other, a plurality of inner barrier ribs in a display region between the first and second substrates, the inner barrier ribs being arranged to define display discharge cells between the first and second substrates, a plurality of dummy barrier ribs in a non-display region between the first and second substrates, the non-display region being peripheral to the display region, a plurality of electrodes between the first and second substrates to generate a discharge in the display discharge cells, a first dielectric layer on the first substrate, the first dielectric layer overlapping the display region and only a portion of the non-display region, at least one phosphor layer in each of the display discharge cells, and a frit in the non-display region connecting the first and second substrates, the dummy barrier ribs being arranged between the frit and the inner barrier ribs.

The dummy barrier ribs may be adjacent to the inner barrier ribs, and an edge of the first dielectric layer may be positioned in a region overlapping an area between an outermost dummy barrier rib and an outermost inner barrier rib. The first dielectric layer may overlap the display region and only a portion of the dummy barrier ribs in the non-display region. The first dielectric layer may overlap the display region and at least three dummy barrier ribs, the three dummy barrier ribs being adjacent to the outermost inner barrier rib. The PDP may further include a second dielectric layer on the second substrate.

A height of the inner barrier ribs may substantially equal a height of the dummy barrier ribs as measured relatively to a common reference point along a direction normal to the second substrate, the height of the inner and dummy barrier ribs being greater than a height of the frit as measured relatively to a common reference point along a direction normal to the second substrate. The first substrate may include at least one bent portion, the bent portion being configured to adjust for the height difference between the frit and the inner and dummy barrier ribs, and the entire first dielectric layer being substantially planar. The bent portion of the first substrate and the first dielectric layer may not overlap. The first dielectric layer may overlap a predetermined number of dummy barrier ribs immediately adjacent to the inner barrier ribs, and the bent portion of the first substrate may overlap at least an outermost dummy barrier rib.

A distance between centers of two adjacent discharge cells may be less than or equal to about 650 μm. The plurality of electrodes may include a plurality of sustain electrodes on the first substrate and a plurality of address electrodes on the second substrate. The dummy barrier ribs may be adjacent to the inner barrier ribs along a horizontal direction, the horizontal direction extending along a longitudinal direction of the first and second substrates. The first dielectric layer may not contact the dummy barrier ribs when the first substrate and the second substrate are sealed.

BRIEF DESCRIPTION OF THE DRAWINGS

The above and other features and advantages of the present invention will become more apparent to those of ordinary skill in the art by describing in detail exemplary embodiments thereof with reference to the attached drawing, in which.

DETAILED DESCRIPTION OF THE INVENTION

Figure 1:
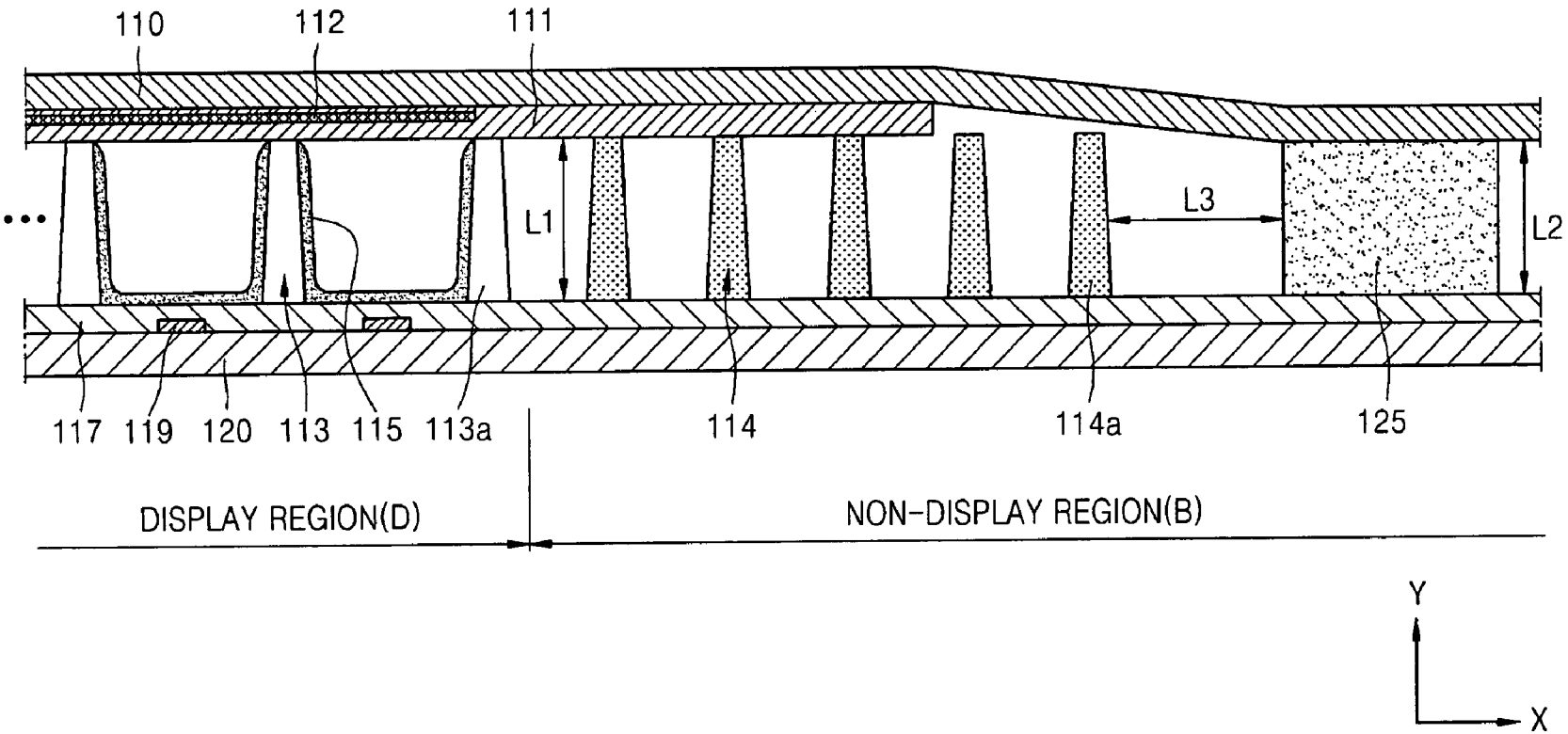
FIG. 1 illustrates a cross-sectional view of an edge region of a PDP according to embodiments of the present invention.

Korean Patent Application No. 10-2008-0024903, filed on Mar. 18, 2008, in the Korean Intellectual Property Office, and entitled: "Plasma Display Panel," is incorporated by reference herein in its entirety.

Exemplary embodiments of the present invention will now be described more fully hereinafter with reference to the accompanying drawings, in which exemplary embodiments of the invention are illustrated. Aspects of the invention may, however, be embodied in different forms and should not be construed as limited to the embodiments set forth herein. Rather, these embodiments are provided so that this disclosure will be thorough and complete, and will fully convey the scope of the invention to those skilled in the art.

In the figures, the dimensions of elements and regions may be exaggerated for clarity of illustration. It will also be understood that when an element is referred to as being "on" another element or substrate, it can be directly on the other element or substrate, or intervening elements may also be present. Further, it will be understood that the term "on" can indicate solely a vertical arrangement of one element with respect to another element, and may not indicate a vertical orientation, e.g., a horizontal orientation. In addition, it will also be understood that when an element is referred to as being "between" two elements, it can be the only element between the two elements, or one or more intervening elements may also be present. Like reference numerals refer to like elements throughout.

Hereinafter, a PDP will be described according to embodiments of the present invention. Referring to FIG. 1, the PDP may include a first panel and a rear panel. The first panel may include a first substrate 110, a first dielectric layer 111 on the first substrate 110, a plurality of sustain electrodes 112 between the first substrate 110 and the first dielectric layer 111, and a protective layer (not shown) on the first dielectric layer 111. The rear panel may include a second substrate 120, a second dielectric layer 117 on the second substrate 120, and a plurality of address electrodes 119 between the second substrate 120 and the second dielectric layer 117. A plurality of inner barrier ribs 113 and dummy barrier ribs 114 may be formed between the first and second substrates 110 and 120 to define inner and dummy discharge cells (not shown), respectively. At least one phosphor layer 115 may be formed in each inner discharge cell. The sustain and address electrodes 112 and 119, the protective layer, the second dielectric layer 117, and the phosphor layer 115 may be any suitable sustain electrode, address electrode, protective layer, second dielectric layer, and phosphor layer, respectively, in terms of, e.g., structure, composition, method of manufacturing, and so forth.

The inner barrier ribs 113 of the PDP may be arranged in any suitable configuration, e.g., a stripe pattern, a rectangular shape, and so forth, to define the inner discharge cells in a display region D of the PDP, i.e., a region corresponding to the discharge cells for forming an image, between the first and second substrates 110 and 120, so visible light emitted from the inner discharge cells may form images. For example, each of the inner barrier ribs 113 may be a double barrier rib. The inner barrier ribs 113 may be formed on the second substrate 120, and may extend along a first direction, e.g., along the y-axis, toward the first substrate 110 to have a first length L1, e.g., about 185 μm.

The dummy barrier ribs 114 may be arranged outwardly with respect to the inner barrier ribs 113 along vertical and horizontal directions to define the non-display discharge cells in a non-display region B of the PDP, i.e., a region surrounding the display region D and not emitting light. For example, as illustrated in FIG. 1, the dummy barrier ribs 114 may be formed adjacent to an outermost inner barrier rib 113*a* of the inner barrier ribs 113, i.e., an inner barrier rib 113 positioned farthest from a center of the display region D along the x-axis. The dummy barrier ribs 114 may extend from the second substrate 120 to the first substrate 110 to have a substantially same length along the first direction as the inner barrier ribs 113. Any suitable number of dummy barrier ribs 114 may be used. For example, as illustrated in FIG. 1, five longitudinal structures of dummy barrier ribs 114 may be formed parallel to the outermost inner barrier rib 113*a*. The dummy barrier ribs 114 may reduce vibrations and noise, and may protect the PDP from contamination. Further, the dummy barrier ribs 114 may protect the inner barrier ribs 113 during formation thereof, e.g., during a sand-blasting procedure for forming the inner barrier ribs 113.

A frit 125 may be coated between the first and second substrates 110 and 120 in the non-display region B to form a sealed space between the first and second substrates 110 and 120. The frit 125 may be coated along edges of the first and second substrates 110 and 120, so the frit 125 may be external to the dummy barrier ribs 114. In other words, as illustrated in FIG. 1, the dummy barrier ribs 114 may be within the sealed space between the first and second substrates 110 and 120, i.e., the dummy barrier ribs 114 may be between the frit 125 and the inner barrier ribs 113. The frit 125 may have a second length L2 along the first direction, e.g., along the y-axis, as measured from an upper surface of the second substrate 120 to a lower surface of the first substrate 110. The second length L2, e.g., about 160 μm, may be shorter than the first length L1, i.e., the frit 125 may be shorter than the inner and dummy barrier ribs 113 and 114.

The frit 125 may be spaced a predetermined distance from an outermost dummy barrier rib 114*a* along a second direction, i.e., a dummy barrier rib 114 positioned farthest from the outermost barrier rib 113*a* along the x-axis. As illustrated in FIG. 1, the predetermined distance may be a third length L3, as measured from an outermost edge of the outermost dummy barrier rib 114*a* to an edge of the frit 125 facing the outermost dummy barrier rib 114*a*. The third length L3 may be adjusted, e.g., number of dummy barrier ribs 114 may be minimized, as will be discussed in more detail below.

The first dielectric layer 111 may be formed to a predetermined thickness, i.e., a distance as measured along the first direction, and may be disposed on the first substrate 110 to cover the sustain electrodes 112, i.e., the sustain electrodes 112 may be between the first dielectric layer 111 and the first substrate 110. As illustrated in FIG. 1, the first dielectric layer 111 may be formed between the first substrate 110 and the inner barrier ribs 113, and may completely overlap the inner barrier ribs 113. For example, the first dielectric layer 111 may completely overlap the entire display region D of the PDP.

As further illustrated in FIG. 1, the first dielectric layer 111 may be positioned so an edge thereof may be disposed in a region between an outermost edge of the display region D, i.e., an outermost edge of the outermost inner barrier rib 113*a*, and the outermost dummy barrier rib 114*a*. In other words, the first dielectric layer 111 may extend along a second direction, e.g., along the x-axis, to completely overlap the display region D and additionally overlap a portion of the non-display region B. For example, as illustrated in FIG. 1, the first dielectric layer 111 may be formed to continuously, i.e., without interruptions, overlap the display region D and three dummy barrier ribs 114 in the non-display region B. In another example, the first dielectric layer 111 may overlap the display region D and five dummy barrier ribs 114. In this respect, it is noted that a size of the first dielectric layer 111 may be adjusted to correspond to a size and model of a respective PDP, so at least one outermost edge of the first dielectric layer

111, e.g., an edge along the x-axis of the PDP, may be disposed between the edge of the display region D and an outermost edge of the outermost dummy barrier rib 114*a*. It is further noted that three dummy barrier ribs 114 may define two dummy discharge cells, i.e., cells used for comparing a display discharge cell to a dummy discharge cell when phosphor patterns in the display discharge cell are tested.

When the first dielectric layer 111 is coated on the first substrate 110 so that an edge of the first dielectric layer 111 is disposed to correspond to a region between the outermost edge of the display region D and the outermost dummy barrier rib 114*a*, a bending force applied to the first substrate 110 in order to press the first and second substrates 110 and 120 together via the frit 125 may not impart a substantial effect on the first dielectric layer 111. More specifically, when the bending force is applied to the first substrate 110, a central portion of the first substrate 110 may remain directly on the first dielectric layer 111 and parallel thereto, and a peripheral portion of the first substrate 110 may be bent toward the second substrate 120 due to the difference between the first and second lengths L1 and L2. While an end portion of the first substrate 110 may be directly on the frit 125 and substantially parallel thereto, a portion of the first substrate 110 may extend diagonally from the central portion of the first substrate 110 to the end portion of the first substrate 110, as illustrated in FIG. 1.

In particular, as further illustrated in FIG. 1, the diagonal portion of the first substrate 110 may extend from the edge of the first dielectric layer 111 to an edge of the frit 125, and may overlap the third length L3. The third length L3 may be adjusted, e.g., the third length L3 may be widened, in order to provide sufficient space for the first substrate 110 to bend without substantially affecting the first dielectric layer 111. It is noted, however, that even though the third length L3 between the outermost dummy barrier rib 14*a* and the frit 25 may be widened by removing some dummy barrier ribs 14, a number of dummy barrier ribs 14 that is too low may increase vibration and noise.

Since the first substrate 110 may be bent in regions not overlapping the first dielectric layer 111, i.e., due to a shorter length of the dielectric layer 111 along the x-axis as compared to the first substrate 110, the applied bending force may not affect the first dielectric layer 111. Accordingly, a gap between the first substrate 110 and the second substrate 120 may be substantially uniform along an entire perimeter of the PDP, so an edge misdischarge in predetermined discharge cells may be prevented or substantially minimized. For example, a PDP according to embodiments of the present invention may include a 50-inch PDP having a horizontal distance, i.e., along the x-axis, between centers of adjacent discharge cells of about 650 μm or less. It is noted, however, that other sizes and models of PDP are within the scope of the present invention.

Exemplary embodiments of the present invention have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. A plasma display panel (PDP), comprising:

a first substrate and a second substrate facing each other;

a plurality of inner barrier ribs in a display region between the first and second substrates, the inner barrier ribs being arranged to define display discharge cells between the first and second substrates;

a plurality of dummy barrier ribs in a non-display region between the first and second substrates, the non-display region being peripheral to the display region;

a plurality of electrodes between the first and second substrates to generate a discharge in the display discharge cells;

a first dielectric layer on the first substrate, the first dielectric layer overlapping the display region and only a portion of the non-display region;

at least one phosphor layer in each of the display discharge cells; and a frit in the non-display region connecting the first and second substrates, the dummy barrier ribs being arranged between the frit and the inner barrier ribs.

2. The PDP as claimed in claim 1, wherein the dummy barrier ribs are adjacent to the inner barrier ribs, and an edge of the first dielectric layer is positioned in a region overlapping an area between an outermost dummy barrier rib and an outermost inner barrier rib.

3. The PDP as claimed in claim 2, wherein the first dielectric layer overlaps the display region and only a portion of the dummy barrier ribs in the non-display region.

4. The PDP as claimed in claim 3, wherein the first dielectric layer overlaps the display region and at least three dummy barrier ribs, the three dummy barrier ribs being adjacent to the outermost inner barrier rib.

5. The PDP as claimed in claim 1, further comprising a second dielectric layer on the second substrate.

6. The PDP as claimed in claim 1, wherein a height of the inner barrier ribs substantially equals a height of the dummy barrier ribs as measured relatively to a common reference point along a direction normal to the second substrate, the height of the inner and dummy barrier ribs being greater than a height of the frit as measured relatively to a common reference point along a direction normal to the second substrate.

7. The PDP as claimed in claim 6, wherein the first substrate includes at least one bent portion, the bent portion being configured to adjust for the height difference between the frit and the inner and dummy barrier ribs, and the entire first dielectric layer being substantially planar.

8. The PDP as claimed in claim 7, wherein the bent portion of the first substrate and the first dielectric layer do not overlap.

9. The PDP as claimed in claim 7, wherein the first dielectric layer overlaps a predetermined number of dummy barrier ribs immediately adjacent to the inner barrier ribs, and the bent portion of the first substrate overlaps at least an outermost dummy barrier rib.

10. The PDP as claimed in claim 1, wherein a distance between centers of two adjacent discharge cells is less than or equal to about 650 μm.

11. The PDP as claimed in claim 1, wherein the plurality of electrodes includes a plurality of sustain electrodes on the first substrate and a plurality of address electrodes on the second substrate.

12. The PDP as claimed in claim 1, wherein the dummy barrier ribs are adjacent to the inner barrier ribs along a horizontal direction, the horizontal direction extending along a longitudinal direction of the first and second substrates.

13. The PDP as claimed in claim 1, wherein the first dielectric layer does not contact the dummy barrier ribs when the first and second substrates are sealed.

* * * * *